US006023026A

United States Patent [19]

Funahashi et al.

[11] Patent Number: 6,023,026

[45] **Date of Patent: *Feb. 8, 2000**

[54] WIRE ROPE

[75] Inventors: Nobuhiro Funahashi; Hiroaki Furukawa, both of Takarazuka, Japan

[73] Assignee: Nippon Cable Systems Inc., Takarazuka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,935

[22] Filed: Oct. 2, 1997

[30] Foreign Application Priority Data

Oct. 2, 1996 [JP] Japan ..... 8-261671

[51] Int. Cl.[7] ..... H01B 5/08

[52] U.S. Cl. ..... 174/128.1

[58] Field of Search ..... 174/128.1, 128.2, 174/126.1, 106 R

[56] References Cited

U.S. PATENT DOCUMENTS

| | | | |
|---|---|---|---|
| 952,161 | 3/1910 | Whyte | 174/126.1 X |
| 3,240,570 | 3/1966 | Grimes, Jr. et al. | 174/128.1 X |
| 3,835,242 | 9/1974 | Critchlow et al. | 174/128.1 X |
| 3,942,309 | 3/1976 | Cahill | 57/9 |
| 4,079,510 | 3/1978 | McGrath et al. | 174/128.1 X |
| 4,819,914 | 4/1989 | Moore | 174/128.1 X |

OTHER PUBLICATIONS

*Anaconda Bare and Weatherproof Aluminum Wire and Cable*, Catalogue No. C–78, published by Anaconda Wire and Cable Co., 1949, p. 4.

*Primary Examiner*—Dean A. Reichard
*Attorney, Agent, or Firm*—Antonelli, Terry, Stout & Kraus, LLP

[57] ABSTRACT

A stranded wire rope of the present invention is composed of a plurality of wires. The stranded wire rope is subjected to swaging. A mean wire diameter ratio of the plurality of wires is at most 5%, and a wire gap ratio is in a range between 20% and 35% due to sujecting the stranded wire rope to swaging. The mean wire diameter ratio and the wire gap ratio are defined as:

$$\text{mean wire diameter ratio}=(d/D)\times 100(\%)$$

$$\text{wire gap ratio}=(1-(S/A))\times 100(\%)$$

where d: mean diameter of each wire,

D: diameter of the wire rope before subjecting the wire rope to swaging,

S: summation of sectional areas of each of the wires constituting the stranded wire rope, and A: area of circumscribed circle of the wire rope after subjecting the wire rope to swaging.

9 Claims, 10 Drawing Sheets

WIRE ROPE

BACKGROUND OF THE INVENTION

The present invention relates to a wire rope. More particularly to a wire rope comprising a plurality of wires, the wire rope having stranded construction, and the wire rope being subjected to suitable treatment such as swaging.

Generally, in the normal driving condition a seat belt used for an automobile is provided in such a manner that a person seated on the automobile seat is loosely tied by the seat belt. But in the moment of collision, tension is applied to the seat belt in such a manner that in the automobile the person is firmly tied by the seat belt. As a means for operating the seat belt in the emergency, wire rope is generally used. However, there are so many ropes having sufficient flexibility, but lacking tensile strength. This is because the diameter of each wire is reduced in order to increase flexibility.

However, when diameter of each wire is reduced, the gap or space between two adjacent wires of the wires constituting a wire rope increases even if number of the wires is increased. For that reason, the strength of each of the wires per unit area is decreased. Therefore, in the stranded ropes having a predetermined diameter in which both high strength and high flexibility are required, either strength or flexibility is sacrificed.

In Japanese Unexamined Patent Publication No. 508193/1995, as shown in FIG. 6, there is described a stranded wire rope having a construction of 19×7, the stranded wire rope being subjected to swaging so that a wire gap ratio can be 22% which is defined as:

$$\text{wire gap ratio}=(1-(S/A))\times 100\ (\%)$$

wherein

S: summation of sectional areas of each of the wires constituting the stranded wire rope before subjecting to swaging, and A: area of circumscribed circle of the wire rope after subjecting the wire rope to swaging.

However, in this wire rope mean wire diameter ratio is about 6.5% which is defined as:

$$\text{mean wire diameter ratio}=(d/D)\times 100\ (\%)$$

wherein d: mean diameter of each wire before subjecting to swaging, and

D: diameter of the wire rope before subjecting the wire to swaging.

Therefore, in this wire rope, flexibility is not preferable, and this wire rope cannot be practically used as a wire rope for operating a seat belt.

Further, in Japanese Unexamined Patent Publication No. 508193/1995, as shown in FIG. 8, there is described a stranded wire rope having a construction of 19×19, the stranded wire rope being subjected to swaging so that a wire gap ratio can be 12%. However, in this wire rope, distortion due to swaging treatment becomes remarkable. As a result, the strength of the wire rope after subjecting the wire rope to swaging is smaller than that before subjecting the wire rope to swaging. Flexibility is also reduced due to interference of wires. Therefore, this wire rope cannot be used as a wire rope for operating a seat belt.

Furthermore, in Japanese Unexamined Patent Publication No. 508193/1995, as shown in FIG. 7, there is described a stranded wire rope having a construction of 7×7×7, the stranded wire rope being subjected to swaging so that a wire gap ratio can be 36%. However, in this wire rope, wire gap ratio is more than 35%. For that reason, the wire rope having a predetermined diameter cannot satisfy the required strength.

Therefore, this wire rope cannot be used as a wire rope for operating a seat belt.

SUMMARY OF THE INVENTION

The object of the present invention is to solve the problems of the conventional wire rope, and to provide a wire rope having superior flexibility and high tensile strength.

A wire rope of the present invention is a stranded wire rope comprising a plurality of wires each having a circular shape before being subjected to swaging; said stranded wire rope being subjected to swaging; a mean wire diameter ratio of said plurality of wires being at most 5%; a wire gap ratio being in a range between 20% and 35% due to subjecting said stranded wire rope to swaging; said mean wire diameter ratio and said wire gap ratio being defined as:

$$\text{mean wire diameter ratio}=(d/D)\times 100\ (\%)$$

$$\text{wire gap ratio}=(1-(S/A))\times 100\ (\%)$$

wherein d: mean diameter of each wire before the swaging operation, and

D: diameter of the wire rope before subjecting the wire to swaging;

wherein

S: summation of sectional areas of each of the wires constituting the stranded wire rope before the swaging operation, and A: area of circumscribed circle of the wire rope after subjecting the wire rope to swaging.

It is preferable that said stranded wire rope has a construction of 19×19.

It is preferable that said stranded wire rope has a construction of 7×7+6×37.

It is preferable that said stranded wire rope has a construction of 7×7×7.

It is preferable that direction of lay of a first layer is identical to direction of lay of each strand constituting said first layer of said stranded wire rope.

The wire rope in accordance with the present invention can be applied in a wire rope in which diameter is restricted to the predetermined value, high strength and flexibility are required.

DETAILED DESCRIPTION

With reference to attached drawings, the wire rope of the present invention will be explained in detail.

Figure 1:
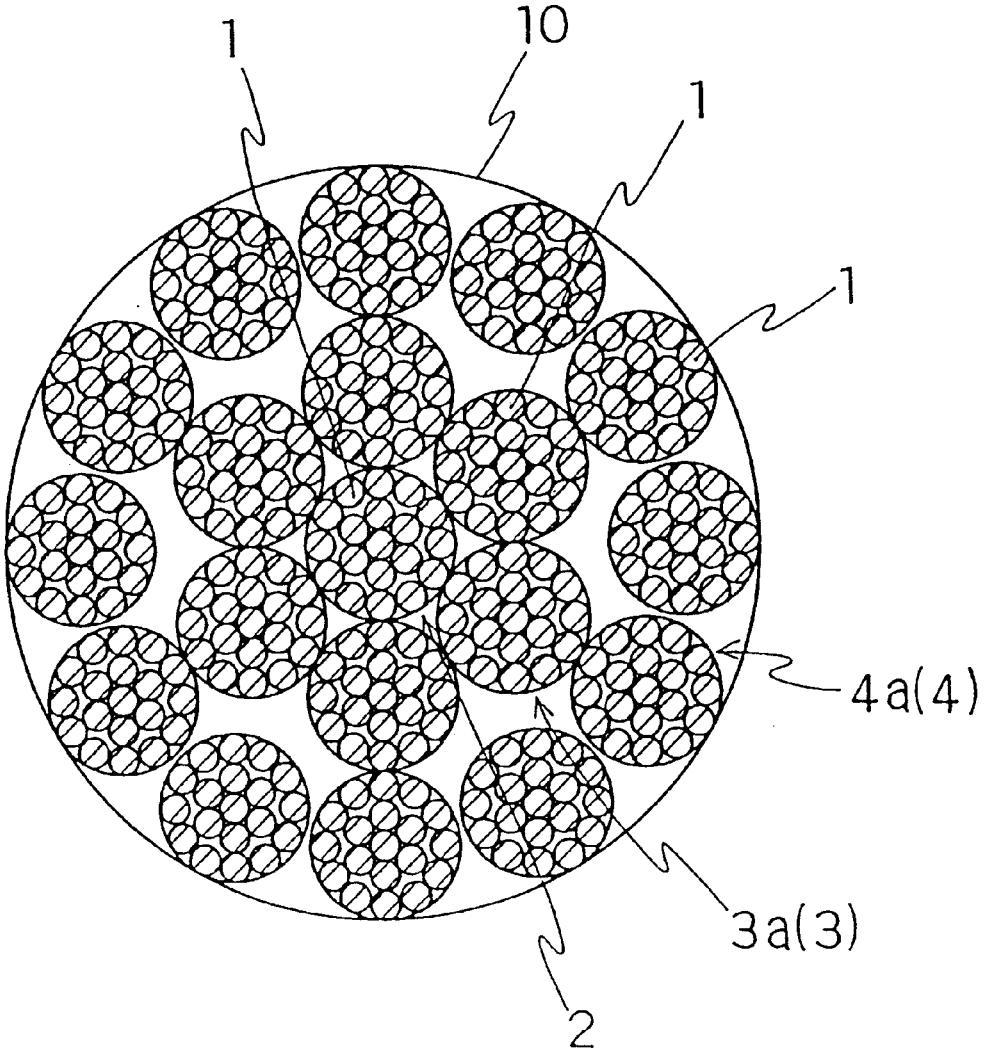
FIG. 1 is a cross sectional view showing an example of a wire rope of the present invention.
Figure 2:
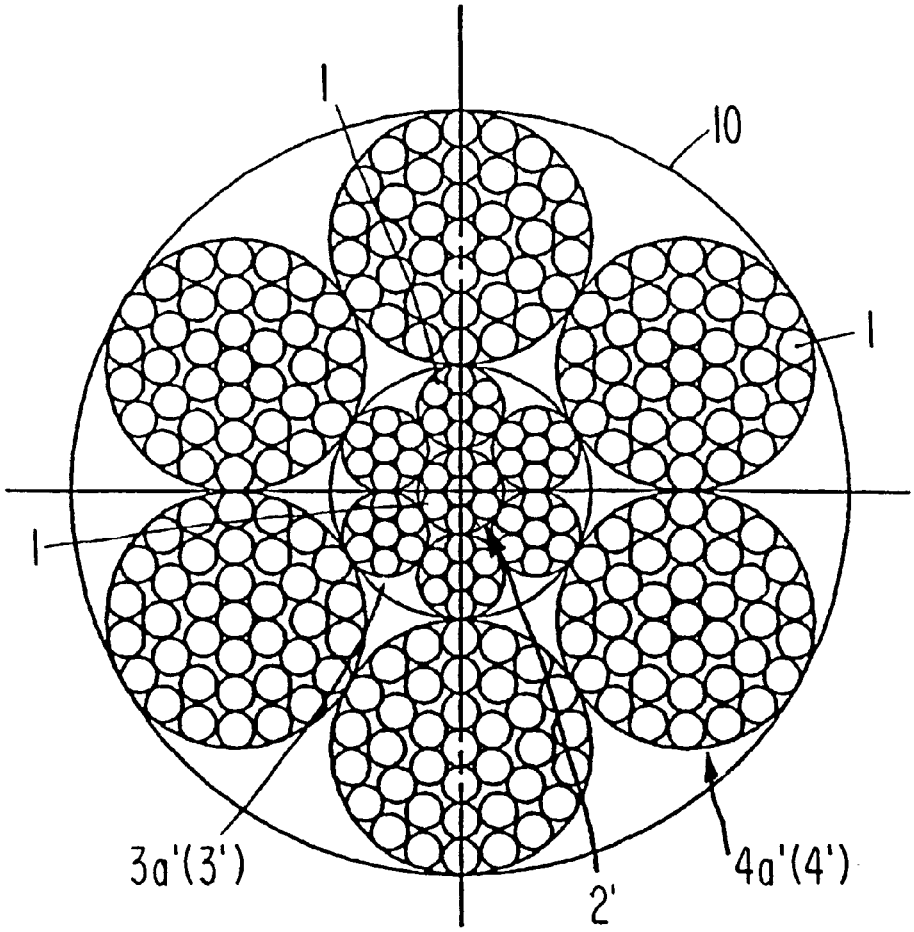
FIG. 2 is a cross sectional view showing another example of a wire rope of the present invention.
Figure 3:
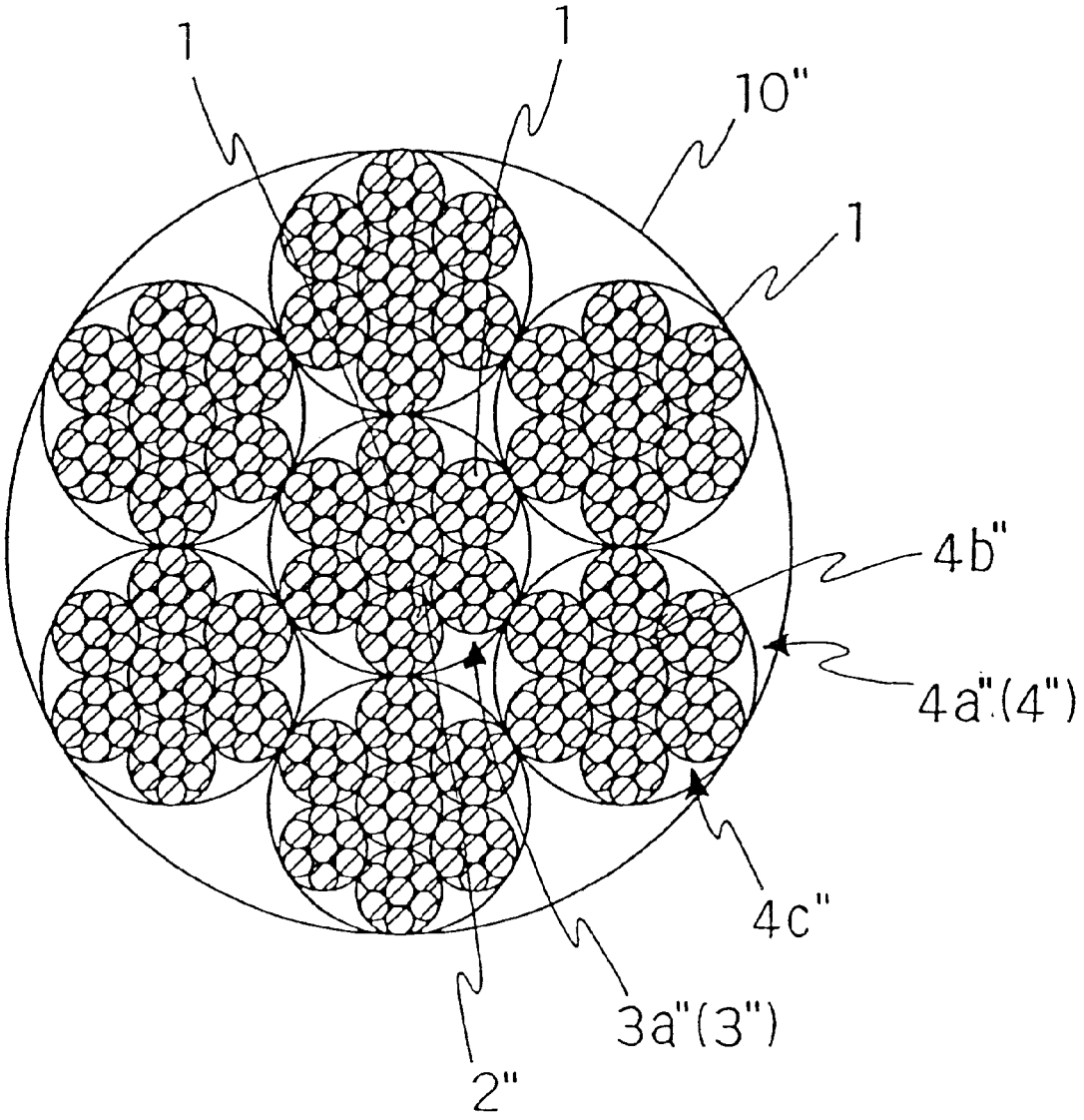
FIG. 3 is a cross sectional view showing still another example of a wire rope of the present invention.
Figure 4:
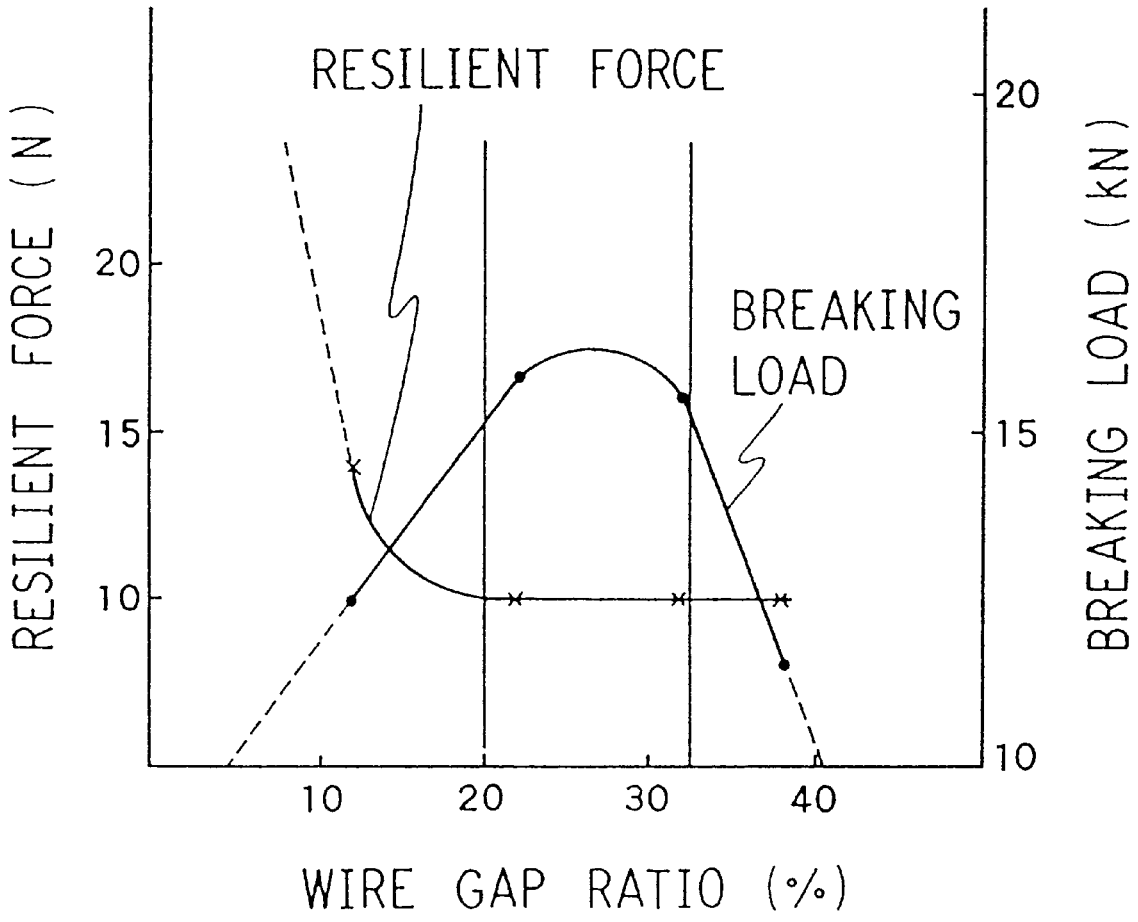
FIG. 4 is a graph showing a relation between wire gap ratio (%) and resilient force (N) as well as breaking load (kN) in a wire rope of the present invention.
Figure 5:
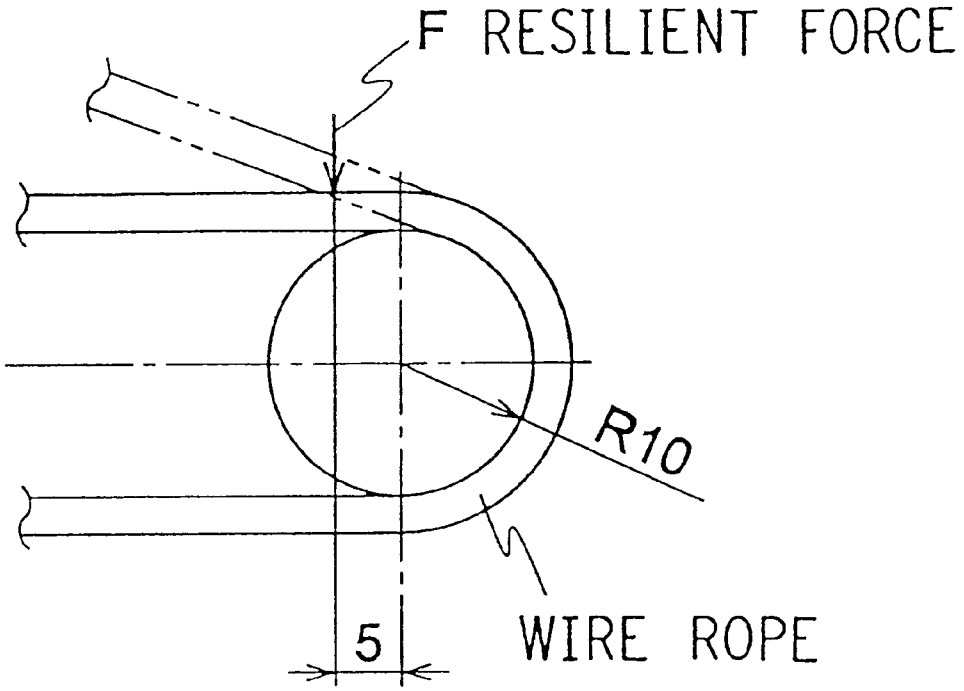
FIG. 5 is an explanatory view showing a method of measuring resilient force.

FIG. 1 is a cross sectional view showing an example of the wire rope of the present invention; FIG. 2 is a cross sectional view showing another example of the wire rope of the present invention; FIG. 3 is a cross sectional view showing still another example of the wire rope of the present invention; FIG. 4 is a graph showing a relation between wire gap ratio (%) and resilient force (N) as well as breaking load (kN) in a wire rope of the present invention; and FIG. 5 is an explanatory view showing a method of measuring resilient force.

Wire rope 10 of the present invention is a stranded wire comprising a plurality of wires 1 each having a circular shape before being subjected to swaging, the stranded wire being subjected to swaging. The wire 1 is preferably made of steel wire material (JIS G 3506 SWRH 62A) specified in Japanese Industrial Standard (JIS). As a means for stranding the wire, 19×19 (FIG. 1), 7×7+6×37 (FIG. 2), or 7×7×7 (FIG. 3) is employed.

Mean wire diameter ratio (%) is defined as:

mean wire diameter ratio=(d/D)×100 (%) where d is a mean diameter of each wire 1 before the swaging operation, and D is diameter of the wire rope 10 before subjecting it to swaging treatment.

The mean wire diameter ratio of the wire rope of the present invention is at most 5%.

Wire gap ratio is defined as:

$$\text{wire gap ratio}=(1-(S/A))\times 100\ (\%)$$

where S is summed area of each of the wires 1 constituting the wire rope 10 before the swaging operation, A is area of a circumscribed circle of the wire rope 10 after subjecting swaging treatment to the wire rope 10.

The wire gap ratio of the wire of the present invention is within the range of between 20% to 35%.

In the case of the wire rope 10 for operating a seat belt, if the mean wire diameter ratio is more than 5%, a predetermined flexibility cannnot be attained. While, in the case the wire gap ratio is less than 20%, distortion of the wire becomes so remarkable when the wire rope is subjected to swaging that the strength of the wire rope is lower than that of the wire rope before subjecting it to the swaging, and the flexibility is also reduced. Further, in the case of the wire gap ratio being more than 35%, sufficient strength of wire rope having a predetermined diameter cannot be obtained.

EXAMPLE 1

In this example, as shown in FIG. 1 wire rope 10 comprises a core strand 2 including nineteen wires 1 stranded in such a manner as to have a left-hand lay (S lay specified in JIS G 3525), a first layer 3 formed around the core strand 2, a second layer 4 formed around the first layer 3.

Figure 10A:
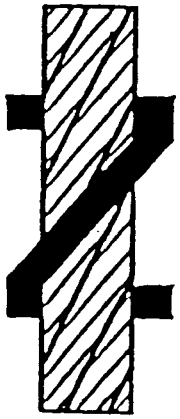
FIGS. 10A and 10B are schematic drawings illustrating a wire rope wherein a direction of lay of a layer of the rope as shown is the same direction of lay of a strand of the layer for a Z lay (FIG. 10A) and an S lay (FIG. 10B)
Figure 10B:
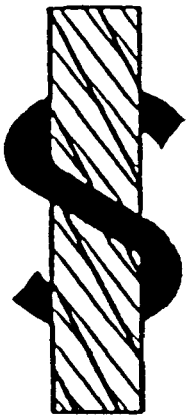

The first layer 3 is stranded on the core strand 2 in such a manner that six pieces of first layer strand 3*a* have a direction of lay of left-hand lay (S lay specified in JIS G 3525). The second layer 4 is stranded on the first layer 3 in such a manner that twelve pieces of second layer strand 4*a* have a direction of lay of right-hand lay (Z lay specified in JIS G 3525). In each first layer strand 3*a,* there are stranded nineteen pieces of wires 1 in such a manner as to have a direction of lay of left-hand lay. Also in each second layer 4*a,* there are stranded nineteen pieces of wires 1 in such a manner as to have a direction of right-hand lay. FIGS. 10A and 10B are drawings from Japanese Industrial Standard (JIS) G3525. FIG. 10A shows the relationship of the direction of a lay of a layer of a wire rope and that of a strand of the layer where these directions are the same for a right-hand lay (Z lay as designated in the drawing). FIG. 10B depicts this relationship for a left-hand lay (S lay).

In the wire rope 10 having a construction of 19×19, and mean wire diameter ratio of 4.0% of this example, breaking load (kN) and resilient force (N) were measured after subjecting a swaging treatment in which diameter of the wire rope was 3.2 mm, so that the wire gap ratio can be 22%. The result of measuring breaking load and resilient force were satisfactory (please see Table 1) in this example.

EXAMPLE 2

In a wire rope having the same construction and mean wire gap ratio as the wire rope of example 1, the wire of this example was subjected to a swaging treatment so that the wire gap ratio can be 32%. After subjecting the wire rope to a swaging treatment in which the diameter of the wire rope was 3.2 mm, breaking load (kN) and resilient force (N) were measured. The result of measuring breaking load and resilient force were satisfactory (please see Table 1).

EXAMPLE 3

In this example, the wire rope 10 is composed of a core strand 2 in which seven wires 1 are stranded to have a direction of lay of right-hand lay, a first layer 3 formed around the core strand 2, and a second layer 4 formed around the first layer 3 (please see FIG. 2).

The first layer 3 is stranded on the core strand 2 in such a manner that six pieces of first layer strands 3*a* have a direction of lay of right-hand lay. The second layer 4 is stranded around the first layer 3 in such a manner that second layer strands 4*a* have a direction of lay of right-hand lay. Each first layer strand 3*a* is stranded in such a manner that seven wires 1 have a direction of lay of right-hand lay. Further, each second layer strand 4*a* is stranded in such a manner that thirty-seven wires 1 have a direction of lay of left-hand lay. Six pieces of the second layer strands 4*a* are stranded around the first layer 3.

In the wire rope having a construction of 7×7+6×37, and having mean wire diameter ratio of 4.6%, the wire rope was subjected to a swaging treatment so that the wire gap ratio can be 25%. After subjecting a swaging treatment in which diameter of the wire rope was 3.2 mm, breaking load (kN) and resilient force (N) were measured. In this example, strength (breaking load) and flexibility (resilient force) were satifactory (please see Table 1).

EXAMPLE 4

In this example, a wire rope 10 is composed of a core strand 2 in which seven wires 1 are stranded in such a manner as to have a direction of lay of right-hand lay, a first layer 3 formed around the core strand 2, and a second layer 4 formed around the first layer 3 (please see FIG. 3).

The first layer 3 is stranded around the core strand 2 in such a manner that six pieces of first layer strands 3*a* have a direction of lay of right-hand lay. The second layer 4 is stranded around the first layer 3 in such a manner that six pieces of second layer strand 4*a* have a direction of lay of right-hand lay. Each first layer strand 3*a* is stranded in such a manner that seven wires 1 have a direction of lay of left-hand lay. Further, the second layer strand 4*a* is composed of a core strand 4*b* stranded in such a manner that seven wires 1 have a direction of lay of left-hand lay, and six pieces of side strand 4*c* stranded around the core strand 4*b* in such a manner as to have a direction of lay of left-hand lay, the side strand 4*c* being composed of seven wires stranded in such a manner as to have a direction of lay of right-hand lay.

In the wire rope having a construction of 7×7×7, and mean wire diameter ratio of 3.7%, the wire rope has been subjected to a swaging treatment in such a manner that wire gap ratio can be 21%. After subjecting a swaging treatment in which diameter of the wire rope was 3.2 mm, breaking load (kN) and resilient force (N) were measured. As a result, strength (breaking load) and flexibility were satisfactory (please see Table 1).

COMPARATIVE EXAMPLE 1

Figure 8:
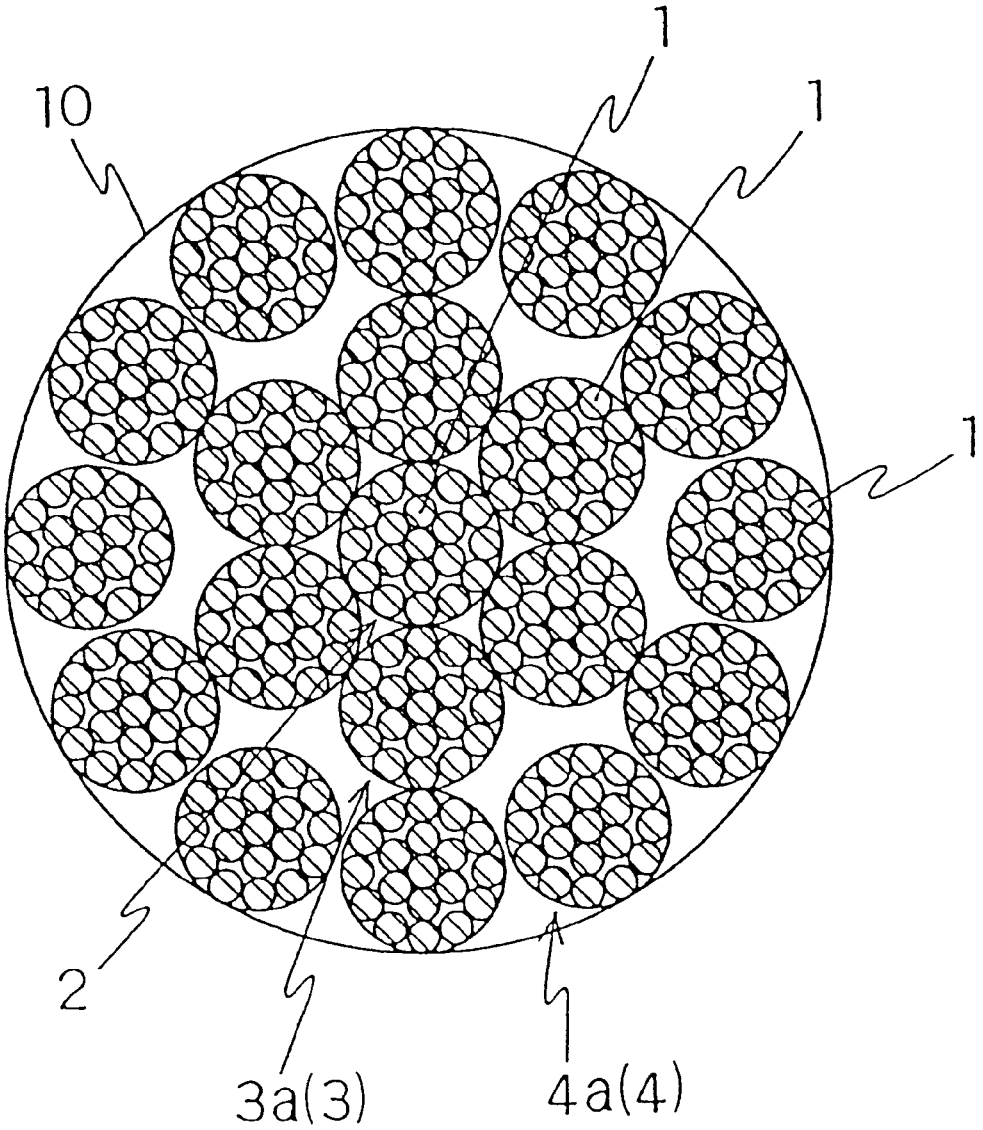
FIG. 8 PRIOR ART
FIG. 8 is a cross sectional view showing still another example of a conventional wire rope.

In the wire rope having the same construction of lay of wire 1 and the same mean wire diameter ratio as the above-mentioned wire rope of example 1 (please see FIG. 8), the wire rope was subjected to a swaging treatment in such a manner that wire gap ratio can be 12%. After subjecting a swaging treatment in which diameter was 3.2 mm, breaking load (kN) and resilient force (N) were measured. In -this comparative example, the flexibility (resilient force) was inferior to the wire rope of examples 1 and 2, and the strength (breaking load) was somewhat lower than the wire rope of examples 1 and 2 (please see Table 1).

COMPARATIVE EXAMPLE 2

In the wire rope having the same construction of lay of wire 1 and the same mean wire diameter ratio (please see FIG. 8), the wire rope was subjected to a swaging treatment in such a manner that wire gap ratio can be 38%. After subjecting swaging treatment in which diameter was 3.2 mm, breaking load (kN) and resilient force (N) were measured. In this comparative example, the wire rope had the same flexibility (resilient force) as the wire rope of examples 1 and 2, and the strength (breaking load) of this comparative example was lower than that of examples 1 and 2 (please see Table 1).

COMPARATIVE EXAMPLE 3

Figure 7:
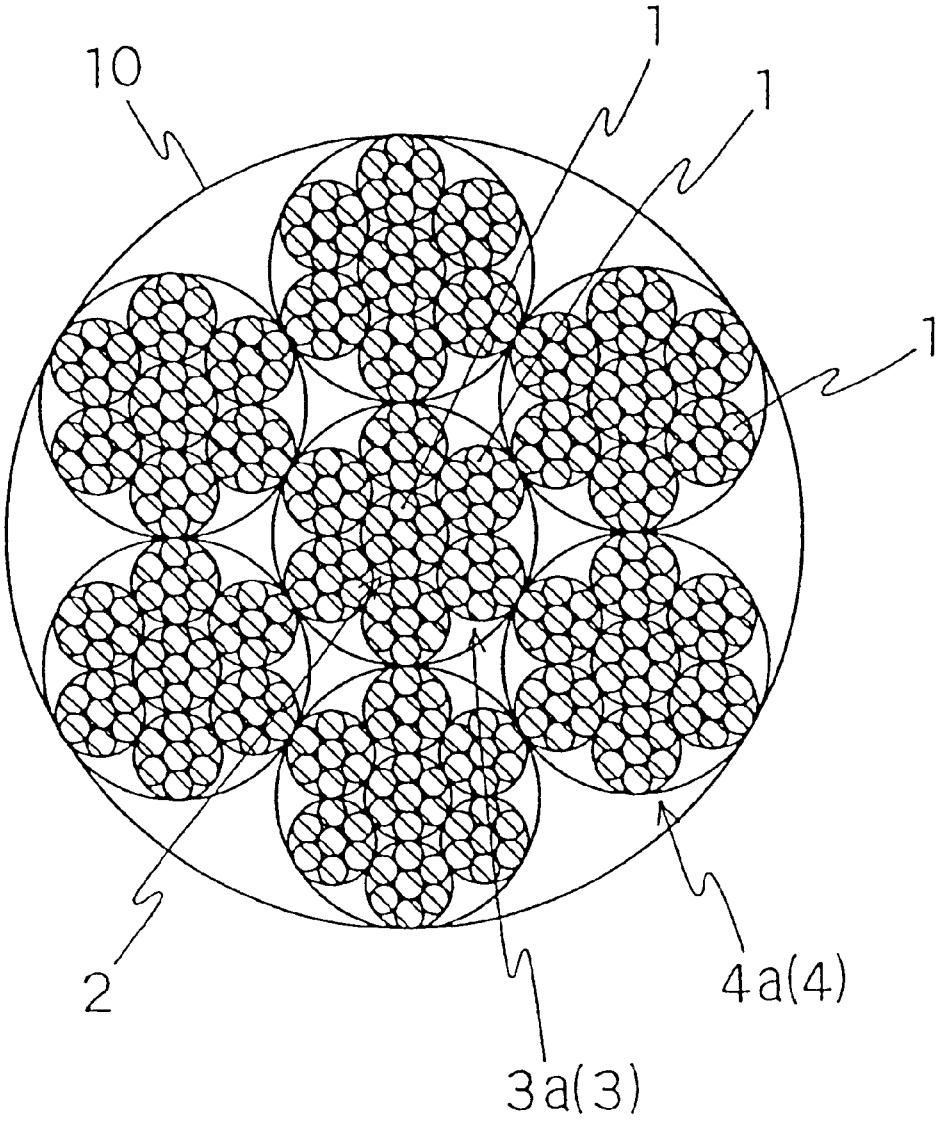
FIG. 7 PRIOR ART
FIG. 7 is a cross sectional view showing another example of a conventional wire rope.

In the wire rope having the same construction of lay and the same mean wire diameter ratio of wire 1 as the above-mentioned wire rope of Example 4 (please see FIG. 7), the wire rope was subjected to swaging treatment in such a manner that wire gap ratio can be 36%. After subjecting a swaging treatment in which diameter was 3.2 mm, breaking load (kN) and resilient force (N) were measured. In this comparative example, the wire rope had the same flexibility (resilient force) as the wire rope of example 4, and the strength (breaking load) of this comparative example was lower than that of example 4 (please see Table 1).

COMPARATIVE EXAMPLE 4

Figure 6:
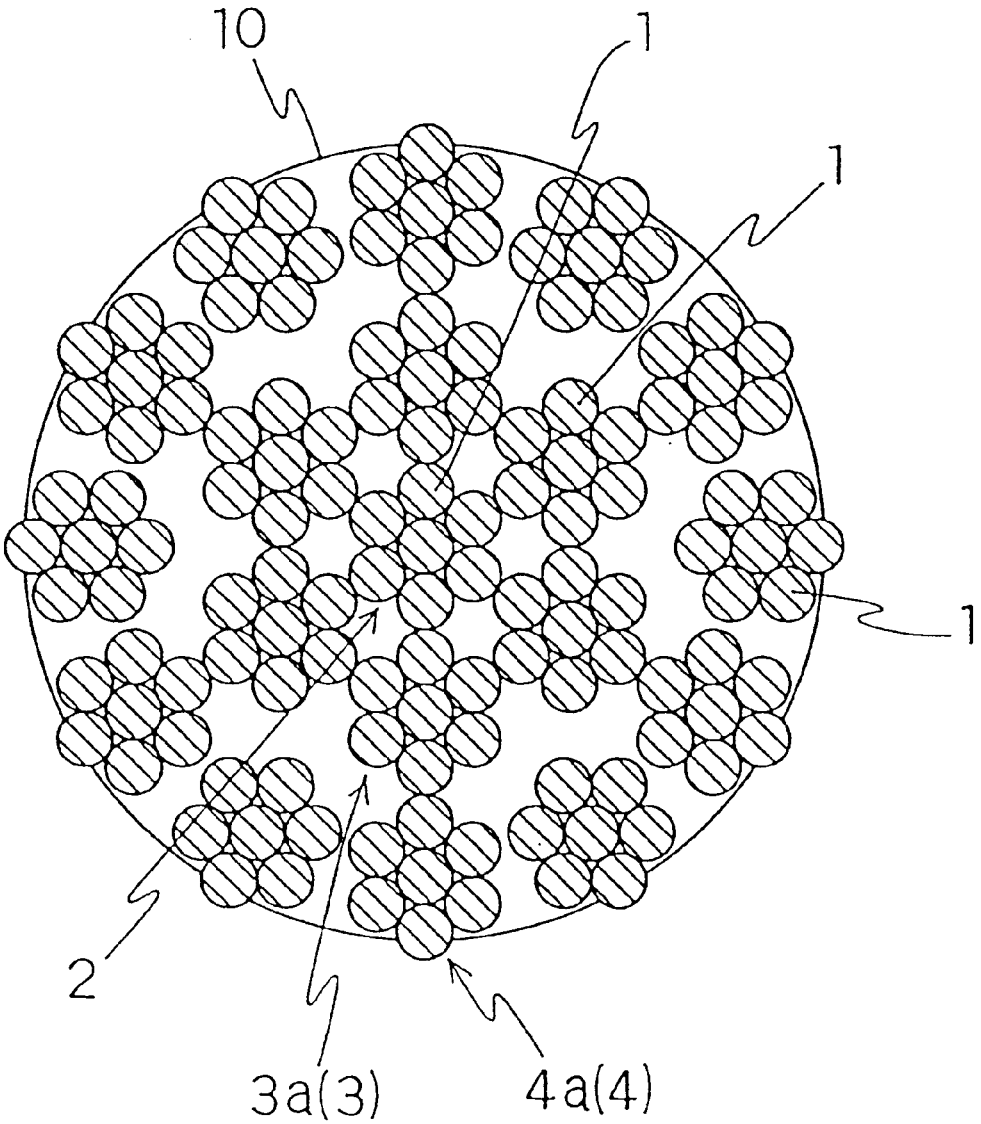
FIG. 6 PRIOR ART
FIG. 6 is a cross sectional view showing an example of a conventional wire rope.

In the wire rope 10 of this comparative example, the wire rope is composed of a core strand 2 in which seven wires 1 are stranded in such a manner as to have a direction of lay of left-hand lay, a first layer 3 formed around the core strand 2, and a second layer 4 formed around the first layer 3 (please see FIG. 6).

The first layer 3 is stranded around the core strand 2 in such a manner that six pieces of first layer strand 3*a* have a direction of lay of left-hand lay. The second layer 4 is stranded around the first layer 3 in such a manner that twelve pieces of second layer strand 4*a* have a direction of lay of right-hand lay. Each of the first layer strand 3*a* and the second layer strand 4*a* is stranded in such a manner that seven wires 1 have a direction of lay of left-hand lay.

In the wire rope having the construction of lay of 19×7, and having mean diameter ratio of 6.7%, the wire rope was subjected to a swaging treartment in such a manner that wire gap ratio can be 23%. After subjecting a swaging treatment in which diameter was 3.2 mm, breaking load (kN) and resilient force (N) were measured. In this comparative example, the wire rope had almost the same strength (breaking load) as the wire rope of example 2, and the flexibility (resilient force) of this comparative example was inferior to example 2 (please see Table 1).

COMPARATIVE EXAMPLE 5

Figure 9:
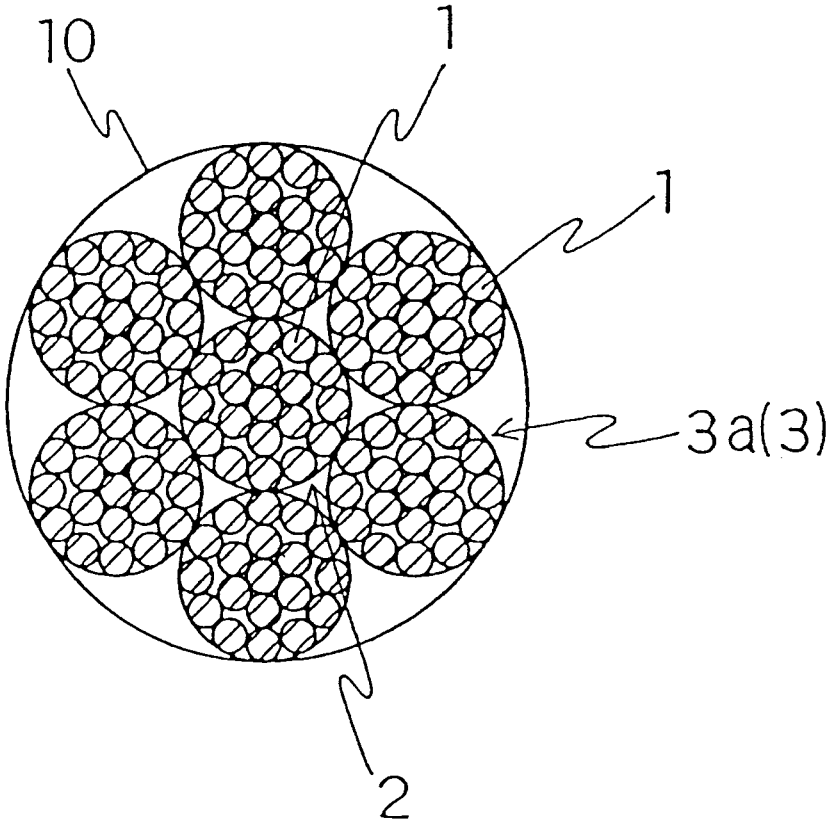
FIG. 9 PRIOR ART
FIG. 9 is a cross sectional view showing yet another example of a conventional wire rope.

In the wire rope 10 of this comparative example, the wire rope is composed of a core strand 2 in which nineteen wires 1 are stranded in such a manner as to have a direction of lay of left-hand lay, and a first layer 3 formed around the core strand 2 (please see FIG. 9).

The first layer 3 is stranded around the core strand 2 in such a manner that six pieces of first layer strand 3*a* have a direction of lay of left-hand lay. The second layer 4 is stranded around the first layer 3 in such a manner that nineteen pieces of second layer strand 4*a* have a direction of lay of right-hand lay.

In the wire rope having the construction of lay of 7×19, and having mean diameter ratio of 6.7%, the wire rope was subjected to a swaging treatment in such a manner that wire gap ratio can be 22%. After subjecting a swaging treatment in which diameter was 3.2 mm, breaking load (kN) and resilient force (N) were measured. In this comparative example, the wire rope had the same strength (breaking load) as the wire rope of example 2, and the flexibility (resilient force) of this comparative example was inferior to example 2 (please see Table 1).

With respect to resilient force, measuring of the resilient force of examples 1 to 4 and comparative examples 1 to 5 was undergone in such a manner as shown in FIG. 5 wherein the resilient force is indicated by the directional arrow F. The indicia 5 and R10 in FIG. 5 respectively show the distance (5 mm) from the center of cross section of the cylindrical shaped member, around which a wire rope, having a winding radius of 10 mm (that is "R10") is wound for measuring the resilient force.

TABLE 1

| | Construction | | | Mechanical property | |
|---|---|---|---|---|---|
| | Construction of lay | Mean wire diameter ratio (%) | Wire gap ratio (%) | Breaking load (kN) Measured value | Resilient force (N) Measured value |
| Ex.1 | 19 × 19 | 4.0 | 22 | 16.0 | 10 |
| Ex.2 | 19 × 19 | 4.0 | 32 | 15.6 | 10 |
| Ex.3 | 7 × 7 + 6 × 37 | 4.6 | 25 | 15.1 | 12 |
| Ex.4 | 7 × 7 × 7 | 3.7 | 21 | 13.4 | 10 |
| Com.Ex.1 | 19 × 19 | 4.0 | 12 | 12.5 | 14 |
| Com.Ex.2 | 19 × 19 | 4.0 | 38 | 11.3 | 10 |
| Com.Ex.3 | 7 × 7 × 7 | 3.7 | 36 | 11.6 | 10 |
| Com.Ex.4 | 19 × 7 | 6.7 | 23 | 15.4 | 26 |
| Com.Ex.5 | 7 × 19 | 6.7 | 22 | 15.6 | 29 |

As a result of plotting the relation between wire gap ratio and resilient force, and the relation between wire gap ratio and breaking load from the wire rope used in examples 1 and 2, it was proved that the relation shown in FIG. 4 was attained.

In accordance with the rope of the present invention, the rope can be applied to the technical field in which diameter of the rope is restricted to the predetermined value, and high strength and flexibility are both required. Further, even in the case where the wire rope has the same strength and the same flexibility as those of the conventional wire rope, diameter of the wire rope of the present invention can be reduced by subjecting a swaging treatment to the wire rope compared with the conventional wire rope. Therefore, relatively wide space can be assuredly achieved, and peripheral elements can be down-sized.

Though several embodiments of the present invention are described above, it is to be understood that the present invention is not limited to the above-mentioned embodiments, and various changes and modifications may be made in the invention without departing from the spirit and scope thereof.

What is claimed is:

1. A stranded wire rope comprising a plurality of wires, said stranded wire rope being subjected to swaging, said wires each having a circular shape before being subjected to said swaging, a mean wire diameter ratio of said plurality of wires being at most 5%, a wire gap ratio being in a range between 20% and 35% due to subjecting said stranded wire rope to swaging, said mean wire diameter ratio and said wire gap ratio being defined as:

$$\text{mean wire diameter ratio}=(d/D)\times 100\ (\%)$$

$$\text{wire gap ratio}=(1-(S/A))\times 100\ (\%)$$

wherein d: mean diameter of each wire before subjecting to swaging,

D: diameter of the wire rope before subjecting the wire rope to swaging,

S: summation of sectional areas of each of the wires constituting the stranded wire rope before subjecting to swaging, and A: area of circumscribed circle of the wire rope after subjecting the wire rope to swaging.

2. The wire rope of claim 1, wherein said wire rope has a construction of lay of 19×19.

3. A stranded wire rope comprising a plurality of wires, said stranded wire rope being subjected to swaging, a mean wire diameter ratio of said plurality of wires being at most 5%, a wire gap ratio being in a range between 20% and 35% due to subjecting said stranded wire rope to swaging, said mean wire diameter ratio and said wire gap ratio being defined as:

$$\text{mean wire diameter ratio}=(d/D)\times 100\ (\%)$$

$$\text{wire gap ratio}=(1-(S/A))\times 100\ (\%)$$

wherein d: mean diameter of each wire before subjecting to swaging,

D: diameter of the wire rope before subjecting the wire rope to swaging,

S: summation of sectional areas of each of the wires constituting the stranded wire rope before subjecting to swaging, and A: area of circumscribed circle of the wire rope after subjecting the wire rope to swaging, wherein said wire rope has a construction of lay of 7×7+6×37.

4. The wire rope of claim 1, wherein said wire rope has a construction of lay of 7×7×7.

5. The wire rope of claim 1, wherein a direction of lay of a first layer of said wire rope is the same direction of lay of a strand of said first layer.

6. The wire rope of claim 2, wherein a direction of lay of a first layer of said wire rope is the same direction of lay of a strand of said first layer.

7. The wire rope of claim 3, wherein a direction of lay of a first layer of said wire rope is the same direction of lay of a strand of said first layer.

8. The wire rope of claim 4, wherein a direction of lay of a first layer of said wire rope is the same direction of lay of a strand of said first layer.

9. The wire rope of claim 1, wherein said plurality of wires are steel wires.

* * * * *

UNITED STATES PATENT AND TRADEMARK OFFICE

CERTIFICATE OF CORRECTION

PATENT NO. : 6,023,026
DATED : February 8, 2000
INVENTOR(S) : Nobuhiro Funahashi, et al.

It is certified that error appears in the above-identified patent and that said Letters Patent is hereby corrected as shown below:

Title page,
Item [73], Assignee: replace "Nippon Cable Systems Inc." with -- Nippon Cable System Inc. --.

Signed and Sealed this

Sixth Day of November, 2001

*Attest:*

Nicholas P. Godici

*Attesting Officer*

NICHOLAS P. GODICI
*Acting Director of the United States Patent and Trademark Office*